US005689541A

United States Patent [19]

Schardt

[11] Patent Number: 5,689,541

[45] Date of Patent: Nov. 18, 1997

[54] X-RAY TUBE WHEREIN DAMAGE TO THE RADIATION EXIT WINDOW DUE TO BACK-SCATTERED ELECTRONS IS AVOIDED

[75] Inventor: Peter Schardt, Roettenbach, Germany

[73] Assignee: Siemens Aktiengesellschaft, Munich, Germany

[21] Appl. No.: 736,957

[22] Filed: Oct. 25, 1996

[30] Foreign Application Priority Data

Nov. 14, 1995 [DE] Germany ..... 195 42 438.7

[51] Int. Cl.[6] ..... H01J 35/16

[52] U.S. Cl. ..... 378/140; 378/113

[58] Field of Search ..... 378/140, 137, 378/138, 139, 113, 101

[56] References Cited

U.S. PATENT DOCUMENTS

| | | | |
|---|---|---|---|
| 3,500,097 | 3/1970 | Perry . | |
| 3,679,927 | 7/1972 | Kirkendall | 378/140 X |
| 4,468,802 | 8/1984 | Friedel . | |
| 5,128,977 | 7/1992 | Danos . | |

FOREIGN PATENT DOCUMENTS

| | | | |
|---|---|---|---|
| 28 07 735 | 8/1979 | Germany | 378/140 |
| 42 09 377 | 9/1993 | Germany . | |
| 53-142889 | 12/1978 | Japan | 378/140 |
| 733479 | 7/1955 | United Kingdom | 378/140 |

*Primary Examiner*—David P. Porta
*Attorney, Agent, or Firm*—Hill, Steadman & Simpson

[57] ABSTRACT

An X-ray tube has a vacuum housing that contains a cathode and an anode, the housing having a radiation exit window. The radiation exit window is electrically conductive, and lies at cathode potential, and is electrically insulated against the vacuum housing, which lies at a potential that is positive in relation to the cathode potential.

6 Claims, 2 Drawing Sheets

X-RAY TUBE WHEREIN DAMAGE TO THE RADIATION EXIT WINDOW DUE TO BACK-SCATTERED ELECTRONS IS AVOIDED

BACKGROUND OF THE INVENTION

1. Field of the Invention

The present invention is directed to an X-ray tube of the type having a vacuum housing containing a cathode and an anode and a radiation exit window provided in the vacuum housing.

2. Description of the Prior Art

An X-ray tube of the above general type is described in U.S. Pat. No. 3,500,097.

In this known X-ray tube, if an excessive electron flow of back-scattered electrons to the radiation exit window occurs, the radiation exit window can be destroyed. It is true that at low power the electrically conductive radiation exit window, which lies at ground potential and is not electrically insulated against the vacuum housing, can conduct away the back-scattered electrons. Limits exist, however, determined by the power densities that arise upon braking of the electrons. This is because the corresponding heat losses must likewise be conducted away from the radiation exit window, and can lead to melting an opening in the radiation exit window.

At higher power levels, the striking force of the back-scattered electrons from the radiation exit window on other parts of the vacuum housing can be displaced by deflection with magnets. This requires, however, that magnets be attached in the interior of the vacuum housing, which is undesirable in itself due to the danger of influencing the primary electrons, since the magnets must be attached immediately alongside the anode plate.

Furthermore, as is known from German OS 31 07 949, corresponding to U.S. Pat. No. 4,468,802, it is possible to provide a screen made of copper that lies at a potential between the anode potential and the cathode potential, the screen being electrically insulated against the vacuum housing, the housing being at a potential that is positive in relation to the cathode potential, in order to keep back-scattered electrons away from the radiation exit window.

In addition, an X-ray tube is known from German OS 42 09 377 that has a vacuum housing that contains a cathode and an anode, which housing is provided with a radiation exit window that lies at ground potential.

Moreover, X-ray tubes are particularly problematic in which for increasing the X-ray power or for the reduction of the load on the anode, the electron beam is projected flatly (e.g., the angle between the anode surface and the electron beam is 10°) onto the anode, as specified e.g., in U.S. Pat. No. 5,128,977. In such an X-ray tube, the portion of the electrons back-scattered by the anode is very high (80%), and moreover the generated X-ray beam and the back-scattered electrons are emitted into the same solid angle element. The thermal load of the radiation exit window is thus particularly high, so that the electrons back-scattered by the anode must be received by a separate target electrode. A further possibility is to incline the radiation exit window in relation to the main propagation direction of the back-scattered electrons. This use of another solid angle element for the X-ray radiation, however, has the consequence that larger regions are nonhomogeneously illuminated with X-ray radiation.

SUMMARY OF THE INVENTION

An object of the present invention is to construct an X-ray tube of the general type described above wherein the risk of damage to the radiation exit window due to being struck by back-scattered electrons is reduced.

The above object is achieved in accordance with the principles of the present invention in an X-ray tube having a vacuum housing containing a cathode and an anode, the housing having an electrically conductive radiation exit window at cathode potential, and the window being electrically insulated against the vacuum housing, and the vacuum housing being at a potential which is positive relative to the cathode potential.

Since the radiation exit window lies at cathode potential, for the incoming back-scattered electrons it has a repelling effect and an energy-selective scattering effect. This causes the electrons to be scattered around the radiation exit window and thus they do not strike the radiation exit window, but instead are incident on the wall of the vacuum housing. The radiation exit window is thus relieved of thermal stress, so that the risk of damage to the radiation exit window by back-scattered electrons, if not removed, is nonetheless reduced. There is no risk to the vacuum housing, since this housing can handle substantially stronger thermal and mechanical loads than the radiation exit window.

In order to ensure the required electrical insulation between the vacuum housing and the radiation exit window in a simple way, in an embodiment of the invention the radiation exit window is connected with the vacuum housing via a body made of insulating material. In one version of the invention, this can be provided with a high-ohm coating, preferably on its inner side. In this way, a static loading of the body of insulating material is avoided.

In another embodiment of the invention, the vacuum housing is provided in its region surrounding the radiation exit window with a cooling apparatus. This ensures that the thermal load of the area of the vacuum housing struck by the electrons is not too high, even with X-ray tubes of extremely high power.

The advantages of the invention are effective particularly when the electron beam emitted from the cathode strikes the anode at an angle such that the angle between the surface of the anode and the electron beam is an acute angle.

DESCRIPTION OF THE PREFERRED EMBODIMENTS

Figure 1:
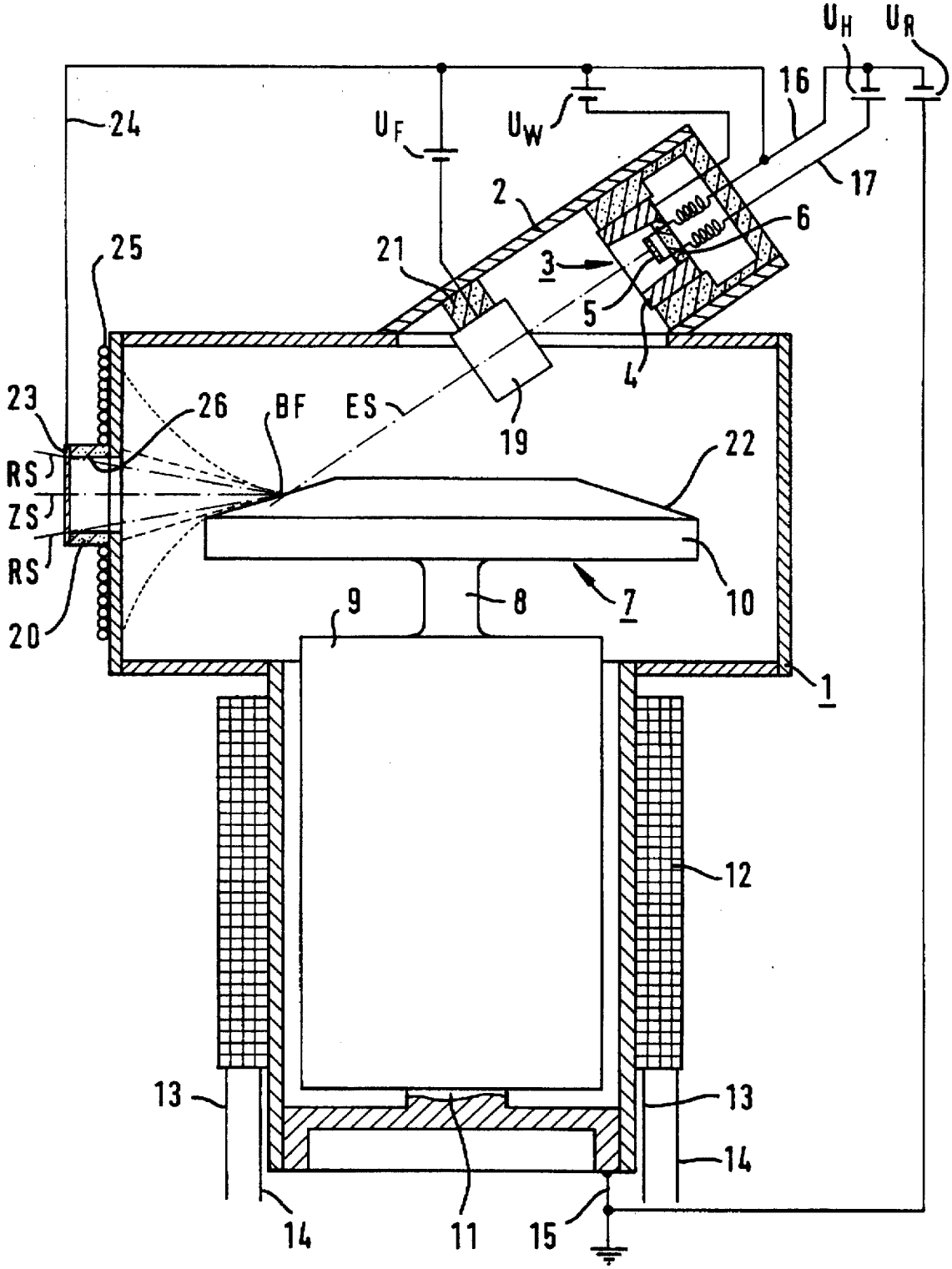
FIG. 1 is a schematic representation of an inventive X-ray tube in longitudinal section.

The X-ray tube shown in FIG. 1, has a vacuum housing 1, which in the case of the exemplary embodiment is produced using metal and ceramic or glass (other materials are possible). Inside the vacuum housing 1, a cathode arrangement 3 is attached in a tubular housing projection 2. The cathode arrangement 3 includes an electron emitter that is contained in a rotationally symmetrical Wehnelt electrode 4. The electron emitter is fashioned in the exemplary embodiment as a flat emitter in the form of a thermionic cathode 5 in the shape of a circular disk, and is attached to the Wehnelt electrode 4 by a ceramic disk 6. A rotating anode 7, lies opposite the thermionic cathode 5. The rotating anode 3 has an anode plate 10 connected with a rotor 9 via a shaft 8. The rotor 9 is rotationally mounted, in a way not shown in FIG. 1, on an axle 11 connected with the vacuum housing 1. In the area of the rotor 9, a stator 12 is mounted on the outer wall of the vacuum housing 1. The stator 12 operates together with the rotor 9 to form an electromotor that serves to drive the rotating anode 3.

During the operation of the X-ray tube, an alternating current is supplied to the stator 12 via conductors 13 and 14, so that the anode plate 10 rotates.

According to FIG. 1, the Wehnelt voltage $U_w$ is across one terminal of the thermionic cathode 5 and the Wehnelt electrode 4. The tube voltage $U_R$ is applied via conductors 15 and 16. The conductor 15 is connected with the axle 11, which in turn is connected in an electrically conductive manner with the vacuum housing 1. The conductor 16 is connected with a terminal of the thermionic cathode 5. The other terminal of the thermionic cathode 5 is connected with a conductor 17. The heating voltage $U_H$ of the thermionic cathode 5 is across the conductor 17 and the conductor 16, so that an electron beam ES with a circular cross-section emanates from the thermionic cathode 5. While in FIG. 1 only the midaxis of the electron beam ES is drawn in, in FIG. 3 its contours or boundary lines are also indicated.

The electron beam ES passes through a focusing electrode 19, attached to the vacuum housing 1 with an insulator 21 interposed therebetween. As shown in FIG. 1, a focusing voltage $U_F$ is across electrode 19 and one terminal of the thermionic cathode 5. As indicated in FIG. 1, the electron beam ES then strikes a focal spot, designated BF, on a striking surface 22 of the anode plate 10. X-ray radiation emanates from the focal spot BF. The usable X-ray beam, whose central beam ZS and edge beams RS are shown in broken lines in FIG. 1 and 2 exits through a radiation exit window 23.

In addition, due to the circular cross-section of the electron beam ES, the precondition is provided for the focal point BF to have an intensity distribution of the X-ray radiation similar to a Gaussian curve, for arbitrary directions.

Figure 2:
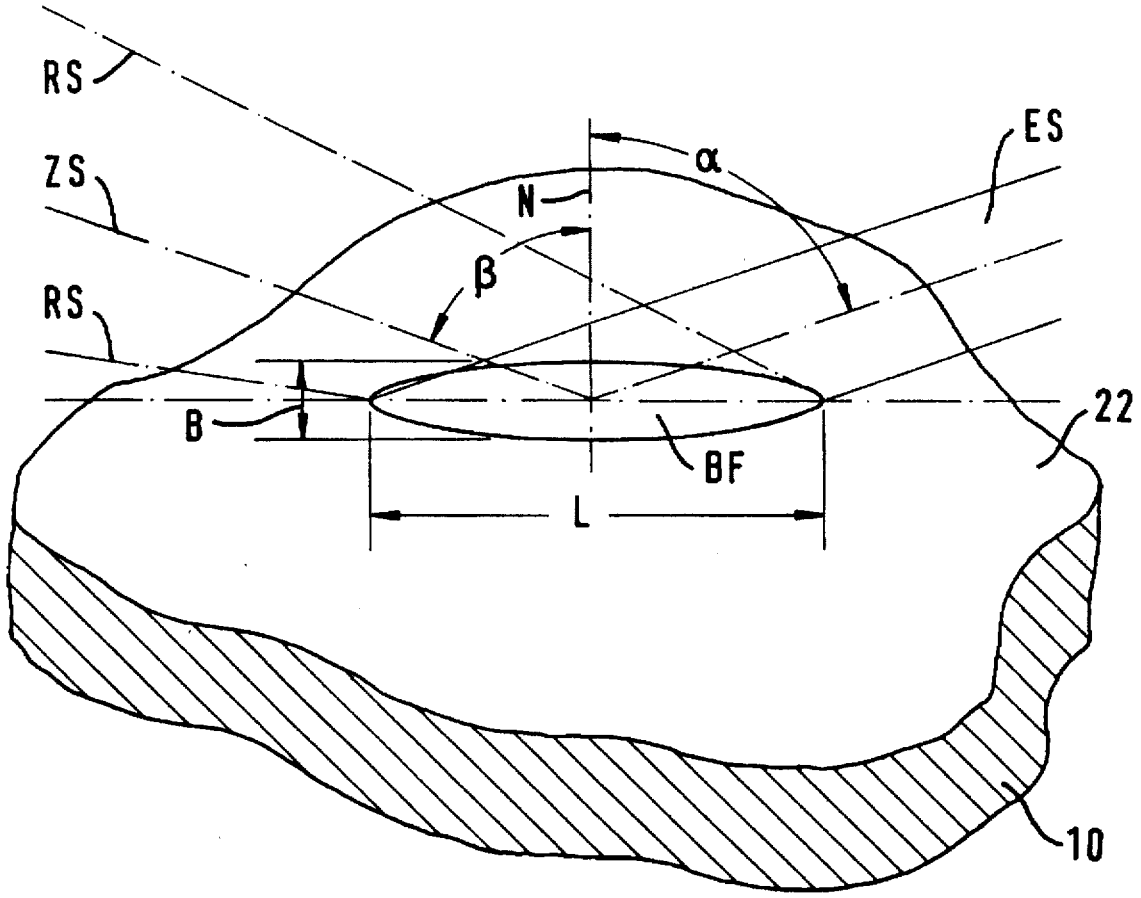
FIG. 2 shows the focal spot of the X-ray tube according to FIG. 1, in an enlarged perspective representation.

In order to prevent the thermal loading of the striking surface 22 from exceeding permissible limits, the electron beam ES strikes the striking surface 22 in the focal point BF at an acute angle to the striking surface 22, or, alternatively described at an angle $\alpha>45°$ to the surface normal N of the striking surface 22, so that a line-shaped, or more precisely an elliptical, focal point BF results (see FIG. 2). The width B of the focal spot BF corresponds to the diameter of the electron beam ES in the immediate vicinity of the impinge surface 22. This diameter depends on the Wehnelt voltage $U_W$ and on the focusing voltage $U_F$, with the given geometry of the thermionic cathode 5, the Wehnelt electrode 4 and the focusing electrode 19, and the given heating current and tube voltage.

In order to achieve the usually sought dimensions of the focal point, the angle $\alpha$ is chosen so that at a diameter D of the electron beam ES of from 0.1 to 2.0 mm, a length L of the focal spot of between 1 and 15 mm results. The indicated diameter range holds for the diameter of the electron beam ES in the immediate vicinity of the striking surface 22 of the anode plate 10.

The position of the radiation exit window 23 is chosen so that the angle $\beta$ between the central beam ZS of the usable X-ray beam and the surface normal N of the striking surface 22 is at least substantially equal to the angle $\alpha$. Seen in the direction of the central beam ZS of the usable X-ray beam, a substantially circular focus results, which is advantageous for a high imaging quality.

The radiation exit window 23 is made of a suitable electrically conductive material (e.g., aluminum or beryllium), and is connected with the vacuum housing 1 via a body 20 of insulating material, formed, for example, from ceramic.

As indicated in FIG. 1 by a corresponding conductor 24, the radiation exit window 23 is set to cathode potential. By this means, the back-scattered electrons, which move toward the radiation exit window 23, are repelled and are scattered in an energy-selective manner. In the case of a circular radiation exit window 23, they are scattered around the radiation exit window 23 in a rotationally symmetrical manner. The electrons thus do not strike the radiation exit window 23, but instead of incident on the region of the wall of the vacuum housing 1 surrounding the radiation exit window 23.

In the exemplary embodiment, the above-identified region of the wall of the vacuum housing 1 is cooled by means of a spiral tube 25, attached to a suitable cooling assembly (not shown), so that thermal overloading of the region of the vacuum housing 1 struck by the electrons is prevented.

In addition, the wall of the vacuum housing 1 has an advantageous effect with regard to the thermal loading, by producing a power density that is still more reduced than that of the radiation exit window 23 in conventional X-ray tubes, due to the scattering of the electrons on the wall of the vacuum housing 1, which is more highly loadable than the radiation exit window 23.

As has been shown in relevant investigations (see L. Reimer, Scanning Electron Microscopy, Springer-Verlag, Berlin, Heidelberg, New York, Tokyo, 1985, page 138), without further measures the electrons are reflected from the striking surface 22 of the anode plate 10 at an angle a of 10° in an angle region of about 30°, indicated with broken lines in FIG. 1. Given a distance of the focal point BF from the radiation exit window 23 of about 3 cm, the corresponding power loss must then be conducted away via a surface about 2 $cm^2$ in size. If alternatively an average deflection angle of 40° is achieved by means of the scattering, as is shown in dotted lines in FIG. 1, a surface of about 20 $cm^2$ is available, and this is in a region, i.e., the wall of the vacuum housing 1, which is mechanically and thermally more stable than the radiation exit window 23, and in addition can be actively cooled.

Since the heat load is thus lower by a factor of 10 per surface element, in certain cases of application an active cooling can even be forgone without, i.e., the power loss can be conducted away, without specific measures, via the insulating and cooling medium, e.g., insulating oil, which is usually located in the protective housing that contains the X-ray tube.

In single-pole X-ray tubes in which, as shown in FIG. 1, the anode and the vacuum housing lie at ground potential and the cathode lies at a potential that is negative in relation to ground, the average angle of deflection by which the back-scattered electrons are deflected depends on the tube voltage $U_R$, i.e., the difference in potential between the cathode and the anode.

Figure 3:
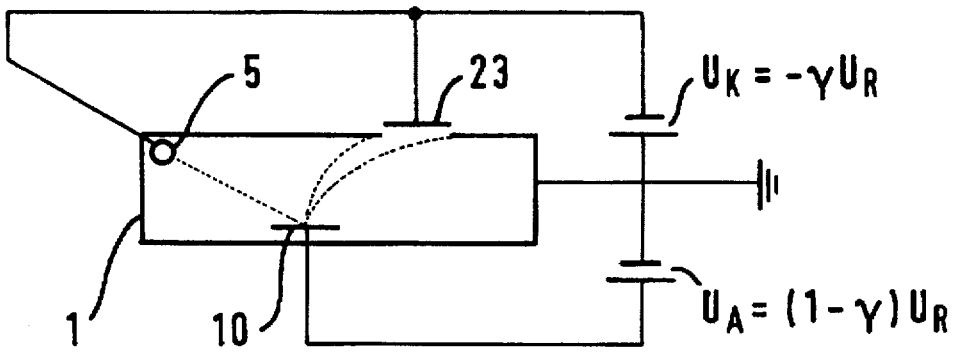
FIG. 3 is a schematic illustration of a further embodiment of the inventive X-ray tube.

In the case of two-pole X-ray tubes in which, as shown schematically in FIG. 3, the vacuum housing 1 lies at ground potential, and in which the cathode 3 lies at a cathode voltage $U_K$ that is negative in relation to ground, and in which the anode lies at an anode voltage $U_A$ that is positive in relation to ground, the average angle of deflection depends on the ratio $\gamma$ of the cathode voltage $U_K$ to the tube voltage $U_R=U_K+U_A$, and becomes larger as $\gamma$ becomes larger. In two-pole X-ray tubes there is thus the possibility in principle of influencing the average angle of deflection.

In order to avoid a static loading of the body 20 of insulating material, this body is provided on its inner side with a high-ohmic coating 26, indicated in FIG. 1, via which the body is connected with the wall of the vacuum housing 1. The coating 26 can be, for example, a sputtered-on layer of a resistant material, e.g., constantan.

The invention is also suited for X-ray tubes in which, differing from the specified exemplary embodiment, no electron beam with a circular cross-section is used. Alternatively to the specified construction of the thermionic cathode 5, there is then also the possibility of using a conventional thermionic cathode fashioned as a spiral filament.

The above-specified exemplary embodiment concerns an X-ray tube with a rotating anode, however, the invention can also be used in X-ray tubes with fixed anodes.

Although modifications and changes may be suggested by those skilled in the art, it is the intention of the inventor to embody within the patent warranted hereon all changes and modifications as reasonably and properly come within the scope of his contribution to the art.

I claim as my invention:

1. An X-ray tube comprising:

a vacuum housing;

an anode and a cathode contained in said vacuum housing;

means for placing said cathode at a cathode potential;

an electrically conductive radiation exit window disposed in an electrically insulated manner/from said vacuum housing;

means for placing said radiation exit window at said cathode potential; and means for placing said vacuum housing at a potential which is positive in relation to said cathode potential.

2. An X-ray tube as claimed in claim 1 further comprising a body of insulating material disposed between said radiation exit window and said vacuum housing.

3. An X-ray tube as claimed in claim 2 wherein said body of insulating material has a high-ohmic coating.

4. An X-ray tube as claimed in claim 3 wherein said body of insulating material has an inner side, facing said vacuum housing, and wherein said high-ohmic coating is disposed on said inner side of said body of insulating material.

5. An X-ray tube as claimed in claim 1 further comprising means for circulating a coolant in a region of said vacuum housing surrounding said radiation exit window.

6. An X-ray tube as claimed in claim 1 wherein said cathode emits an electron beam, and further comprising means for mounting said cathode and said anode in said vacuum housing relative to each other for causing said electron beam to strike said anode at an acute angle.

* * * * *